US005829635A

United States Patent [19]

Brovelli

[11] Patent Number: 5,829,635

[45] Date of Patent: Nov. 3, 1998

[54] TOY WATER GUN HAVING A CONTINUOUS WATER OUTPUT

[75] Inventor: Virginio Brovelli, Taino, Italy

[73] Assignee: Lanard Toys, Ltd., Hong Kong, Hong Kong

[21] Appl. No.: 804,895

[22] Filed: Feb. 24, 1997

[51] Int. Cl.[6] ..... A63H 33/30

[52] U.S. Cl. ..... 222/39; 222/79; 222/189.1; 222/255; 222/276; 222/494; 446/180; 446/475

[58] Field of Search ..... 222/79, 39, 252, 222/255, 275, 276, 278, 189.1, 385, 494; 446/180, 473, 475; 417/486, 487, 515, 521

[56] References Cited

U.S. PATENT DOCUMENTS

| | | | |
|---|---|---|---|
| D. 343,873 | 2/1994 | Aigner | D21/147 |
| 711,144 | 10/1902 | Wright | 222/255 |
| 790,786 | 5/1905 | Davis et al. | 222/255 X |
| 1,733,635 | 10/1929 | Stork | 222/275 X |
| 2,566,487 | 9/1951 | Gora et al. | 222/79 |
| 2,821,803 | 2/1958 | Tandet | 42/57 |
| 3,197,070 | 7/1965 | Pearl et al. | 222/79 |
| 3,365,838 | 1/1968 | Butler et al. | 46/175 |
| 3,616,561 | 11/1971 | Hendricks | 42/1 L |
| 4,591,071 | 5/1986 | Johnson | 222/39 |
| 4,768,681 | 9/1988 | Dean et al. | 222/79 |
| 5,184,756 | 2/1993 | Amron | 222/79 |
| 5,283,970 | 2/1994 | Aigner | 42/57 |
| 5,305,919 | 4/1994 | Johnson et al. | 222/79 |
| 5,322,191 | 6/1994 | Johnson et al. | 222/79 |
| 5,381,928 | 1/1995 | Lee et al. | 222/278 X |
| 5,439,139 | 8/1995 | Brovelli | 222/79 |

*Primary Examiner*—Kevin P. Shaver
*Attorney, Agent, or Firm*—Baker & Botts, LLP

[57] ABSTRACT

A toy water gun comprising a housing, water tank, nozzle, pump assembly, piston drive assembly, and crank handle. The pump assembly comprises (a) first and second cylinders, each cylinder having a first cylinder end with an opening for receiving a piston end and a second cylinder end with an intake port and a discharge port; (b) a piston having a two piston ends, a piston shaft between the two piston ends, and a drive pin on the piston shaft, each piston end inserted into the first open ends of the first and second cylinders, respectively, and being slidable along the longitudinal axes of the cylinders in sealing relation to the cylinder walls; and (c) a device means for filling the two cylinders with water from the water tank and for discharging water from the two cylinders through the nozzle, wherein the filling and discharging device act in cooperation with the slidable movement of the piston ends. The piston drive assembly comprises a cam arm and a coupling wheel. The cam arm has a first end pivotably mounted relative to the housing and a second end coupled to the piston by insertion of the piston drive pin into a first side of an elongated slot disposed on the second end of the cam arm. The coupling wheel has a central shaft on one side, which is attached to the crank handle, and a cam drive pin on the opposite side, which is inserted into a second of the elongated slot.

14 Claims, 8 Drawing Sheets

TOY WATER GUN HAVING A CONTINUOUS WATER OUTPUT

BACKGROUND OF THE INVENTION

Water guns have long been popular toys. Most toy water guns have a pump that is manually operated by a trigger that moves a piston in a cylinder. Such pumps usually operate on two strokes: (1) a discharge stroke, corresponding to the pulling of the trigger; and (2) an intake stroke, corresponding to the restoring of the trigger to its original position (usually by action of a spring). On the discharge stroke, water stored in the cylinder is discharged through a one-way valve into a conduit leading to a nozzle. On the intake stroke, water is drawn into the cylinder from a water tank through another one-way valve and conduit. Because of their two-stroke operation, these guns have the disadvantage of intermittent water output, i.e., the guns shoot a spurt of water on the discharge stroke, but do not shoot on the intake stroke.

A variant of the manually-operated, two-stroke water gun that has enjoyed some popularity in recent years is the battery-powered water gun. This type of water gun has a motor that drives a reciprocating piston pump. The water output from the battery-powered water gun is also intermittent, but the stroke cycle of this gun is short enough that the water output approaches a continuous flow. Nonetheless, a drawback to this gun is its expense. Not only is the water gun itself expensive, but a user must periodically purchase new batteries to replace old, used-up ones.

Another very popular recent entry into the toy water gun market is the pressurized-air water gun. A manually operated piston pumps air into the water tank of the gun. When a trigger valve is opened, the air pressure in the tank expels water from the tank through a discharge conduit and nozzle. As long as the air pressure in the tank is greater than the atmospheric air pressure, the pressurized water gun will shoot a continuous stream of water. The range and strength of the water stream is diminished over time, however, because as the water is discharged, the pressure in the tank steadily decreases. Accordingly, to maintain a powerful output and a long range, a user must operate the air pump frequently, and because it is cumbersome to keep the trigger pulled with one hand and operate the pump with the other hand, the gun is usually not operated simultaneously while it is being pumped. Thus, a drawback to pressurized-air water guns is that a user must interrupt his or her shooting frequently to "reload" the pressure in the water tank. Another disadvantage of these guns, as with battery-powered guns, is that they are relatively expensive as compared to manually-operated, two-stroke water guns.

In addition, because of the linear motion of a piston in a cylinder, most toy water guns utilize an operating mechanism, such as a trigger or slide handle, that moves along the longitudinal axis of the cylinder pump. Such guns usually simulate hand guns or rifles. Other types of guns, such as the Gatling guns that have become popular through television shows and video games, which are operated by a crank handle, have not received much attention in the toy water gun market despite their popularity.

Accordingly, there is a need for an inexpensive toy water gun that has a continuous water output and that may be operated by a Gatling-gun-like crank handle.

SUMMARY OF THE INVENTION

This invention is directed to a toy water gun that may be inexpensively manufactured and that shoots a continuous stream of water by operation of a crank handle. The toy water gun comprises a housing, a water tank, a nozzle, a pump assembly, a piston drive assembly, and a crank handle.

The pump assembly is mounted in the housing and includes (a) a first cylinder and a second cylinder, each cylinder having a first cylinder end with an opening for receiving a piston end and a second cylinder end with an intake port and a discharge port; (b) a piston having a first piston end and a second piston end, a piston shaft between the first and second piston ends, and a drive pin located on the piston shaft, with the first and second piston ends inserted into the first open ends of the first and second cylinders, respectively, each piston end being slidable along the longitudinal axis of the cylinder into which it is inserted in sealing relation to the cylinder walls; and (c) means for filling the first and second cylinders with water from the water tank and means for discharging water from the first and second cylinders through the nozzle, wherein the filling and discharging means act in cooperation with the slidable movement of the first and second piston ends.

Preferably, the means for filling and discharging water from the first and second cylinders comprise intake valves means that interconnect intake conduits to the intake ports of the first and second cylinders and discharge valve means that interconnect discharge conduits to the discharge ports of the first and second cylinders, the intake conduits being connected to the water tank, and the discharge conduits being connected to the nozzle. Preferably, the intake conduits are interconnected to the water tank through a filter means for filtering particulate matter.

The piston drive assembly includes a cam arm and a coupling wheel, the cam arm having a first end with pivoting means for pivotably mounting the cam arm relative to the housing and a second end with an elongated slot. The coupling wheel has a central shaft on a first side and a cam drive pin on the side opposing the first side. The coupling wheel is rotatably mounted relative to the housing and is coupled to the cam arm by inserting the cam drive pin into a first side of the elongated slot. The cam arm is coupled to the piston by inserting the piston drive pin into the side opposing the first side of the elongated slot.

In a preferred embodiment of the piston drive assembly, the center of the coupling wheel is coincident with the piston drive pin when both piston ends are halfway through their strokes; the diameter of the circle traced by the cam drive pin is approximately the length of each cylinder less the width of each piston end; the length of the elongated slot is equal to or greater than the diameter of the circle traced by the cam drive pin; and the pivot end of the cam arm is positioned along a line perpendicular to the longitudinal axis of the two cylinders and equidistant between them.

The crank handle is attached to the central shaft of the coupling wheel, such that rotation of the crank handle causes cooperative movement between the crank handle, coupling wheel, cam drive pin and piston drive pin, thereby enabling the first and second piston ends to move cooperatively and provide a continuous stream of water to the nozzle.

Preferably, for ease of assemblage, the housing is comprised of two parts. In addition, to maintain a watertight seal between the piston ends and the cylinder walls, preferably each piston end contains an O-ring gasket and a piston cover. For ease of assembly and structural integrity, preferably the pump assembly, cam arm and coupling wheel are mounted on an internal support assembly, which is mounted to the housing.

A preferred embodiment of the present invention includes a cylindrical inner barrel and a cylindrical outer barrel attached to the front of the housing, in which the outer barrel is rotatably engaged to the inner barrel. Preferably, the outer barrel contains a first barrel drive gear, the coupling wheel contains a second barrel drive gear, and the first barrel drive gear is coupled to the second barrel drive gear, whereby the outer barrel rotates around the inner barrel when the coupling wheel is rotated by the crank handle.

Another preferred embodiment of the present invention includes a paddle mounted on the internal support assembly and a paddle gear concentrically mounted on the coupling wheel. One end of the paddle is mounted in contact with the teeth of the paddle gear so that a noise effect is created when the coupling wheel is rotated by the crank handle.

A preferred embodiment of the crank handle comprises a base attached to the central shaft of the coupling wheel and a lever handle pivotably attached to the base. Preferably, the base comprises a spring-loaded stopper which locks the lever handle into a position perpendicular to the base. In addition, it is preferred to have a roller around the lever handle for ease of operation of the handle. A preferred embodiment of the nozzle comprises a spring-loaded elastomeric, one-way valve.

These and other features, aspects, and advantages of the present invention will become better understood with regard to the following detailed description, appended claims, and accompanying drawings.

DETAILED DESCRIPTION OF THE INVENTION

Figure 1:
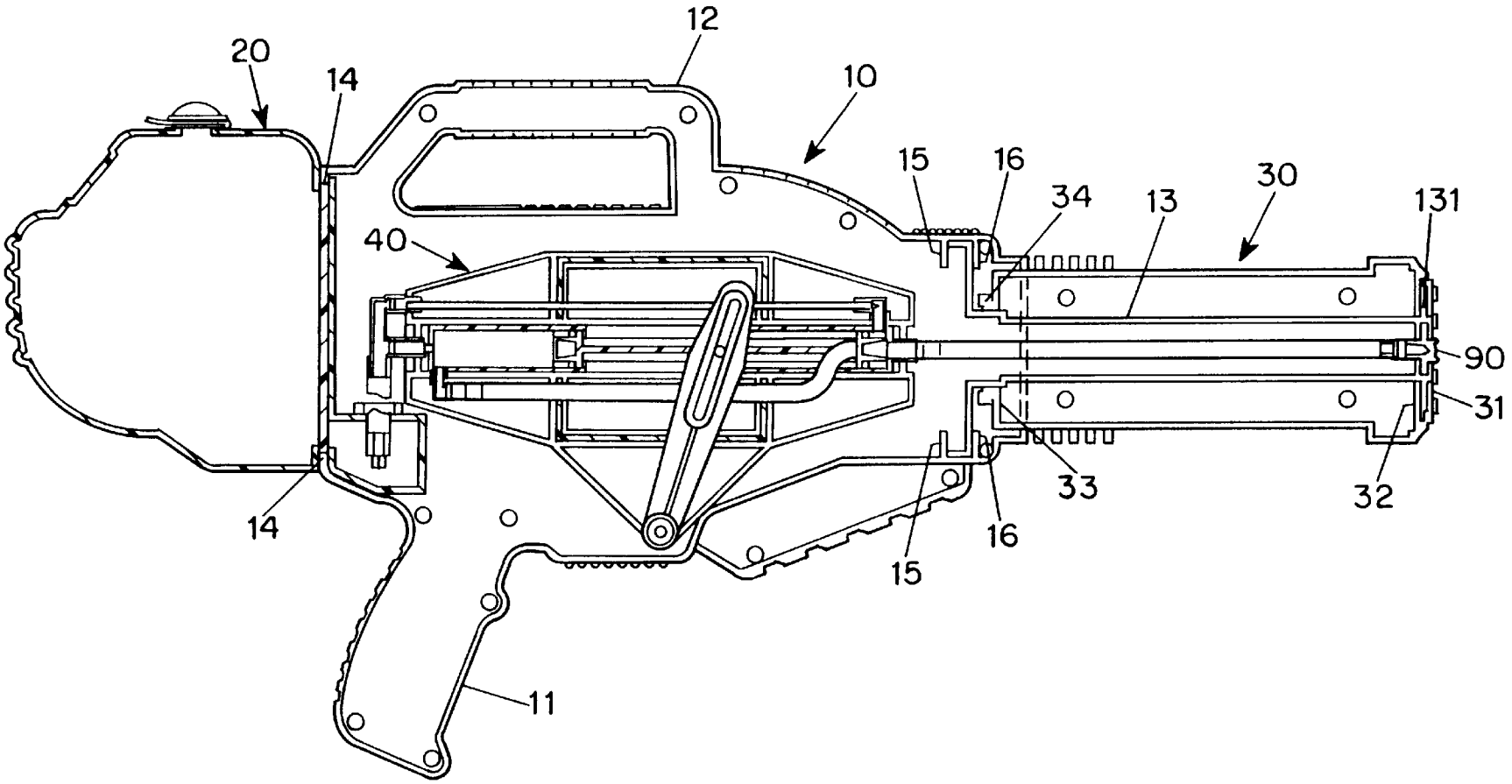
FIG. 1 is a cross-sectional side view of an embodiment of the present invention.
Figure 2:
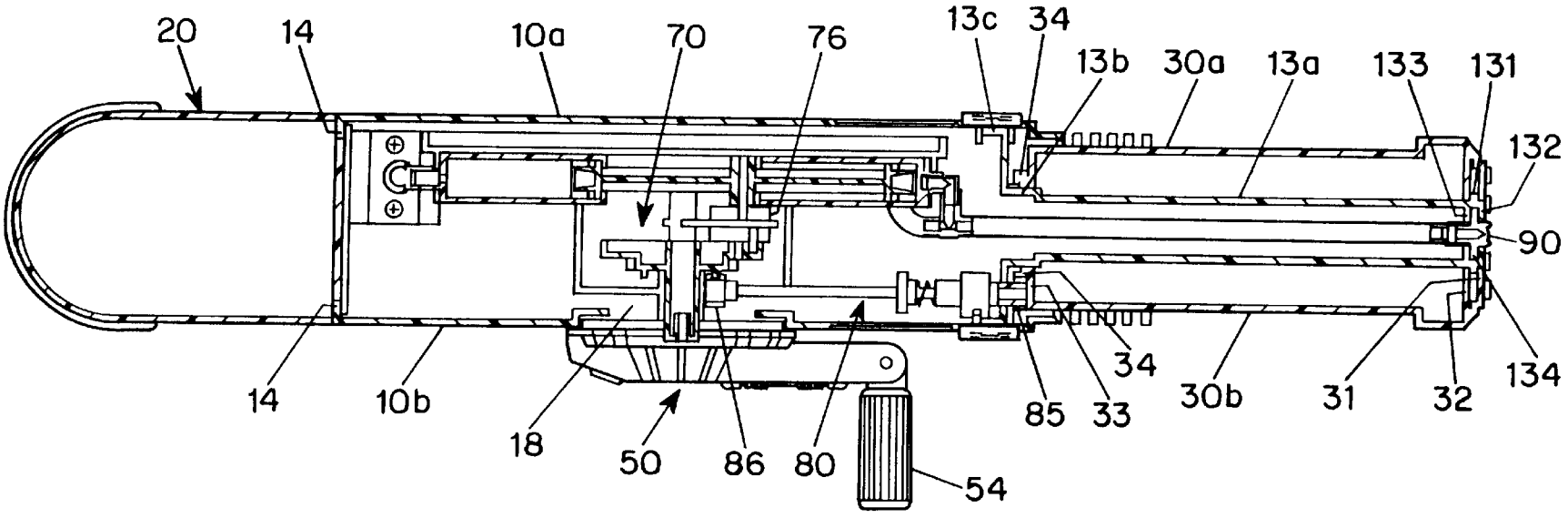
FIG. 2 is a cross-sectional top view of an embodiment of the present invention.

As shown in the drawings, and in particular FIGS. 1 and 2, a preferred embodiment of a water gun according to the present invention includes a housing 10 to which a nozzle 90 is attached to the front and a water tank 20 is attached to the rear. A pump assembly 40 and a piston drive assembly 70 are mounted inside the housing 10. The water gun is operated by a crank handle 50.

The housing 10 of the present invention is preferably composed of two halves 10*a* and 10*b* (not shown in FIG. 1), which are joined together by several screws. The two halves are nearly identical except for an opening 18 in half 10*b*, missing in half 10*a*, which allows the coupling of crank handle 50 to the piston drive assembly 70. Once the two halves are joined, the housing 10 includes a lower handle 11, which is used to hold the gun while in operation, and an upper handle 12, which is used to carry the gun when not in operation. The housing 10 contains a flange 14 in the rear, which fits within a groove 24 in the water tank 20 (shown in FIG. 10) and which is used to connect the water tank to the housing.

The housing 10 also contains an opening in the front for an inner barrel 13 and an outer barrel 30. The inner barrel 13 consists of three concentric cylindrical sections, which from front to rear, smallest to largest radius, are 13*a*, 13*b*, and 13*c*. The inner barrel is coupled to the housing 10 through rear section 13*c*, which fits within two annular flanges 15 and 16 disposed in the housing 10. Section 13*c* may be secured to the housing by conventional means, such as glue or screws, alone or in combination. The inside tip of section 13*a* contains two annular flanges 132 and 133, which together form a groove 134 that receives a flange 95 around the nozzle. The outside tip of section 13*a* contains an annular flange 131 that fits between two annular flanges 31 and 32 of the outer barrel 30. The rear of outer barrel 30 contains an annulus 33, which fits around cylindrical section 13*b* of the inner barrel. The annulus contains a gear wheel 34 that may be used to rotate the outer barrel around the inner barrel. As with the housing, both the inner barrel and the outer barrel are preferably composed of two halves that are assembled together by conventional means, such as glue or screws, alone or in combination.

Figure 3A:
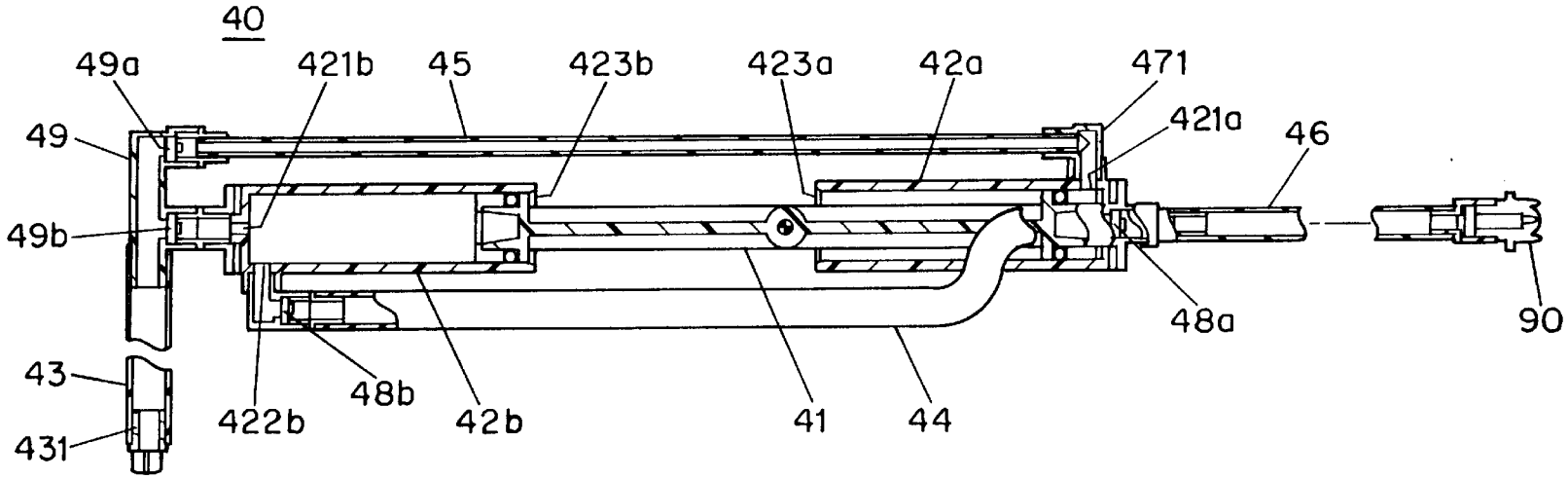
FIG. 3A is a cross-sectional side view of a pump assembly of an embodiment of the present invention.
Figure 3B:
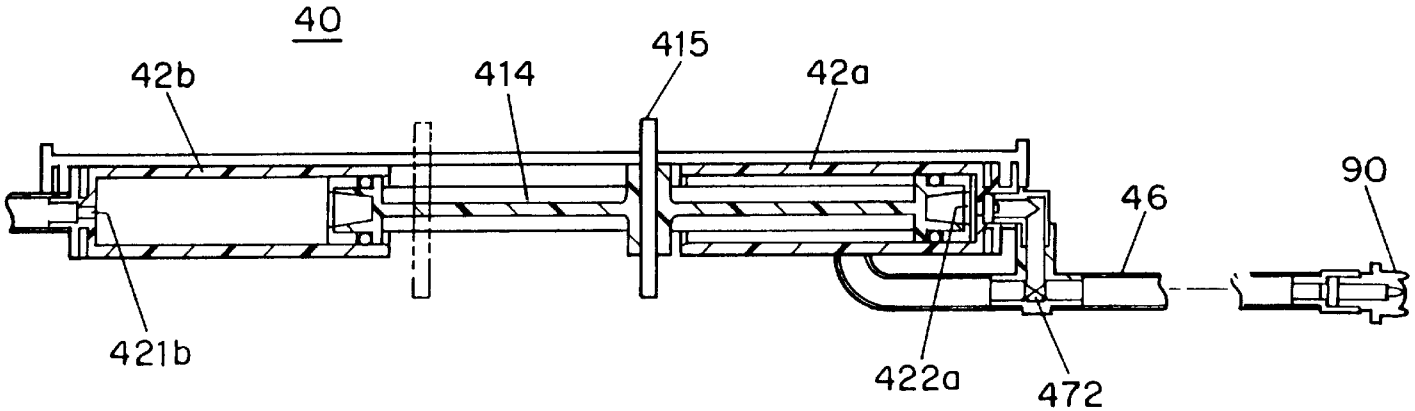
FIG. 3B is a cross-sectional top view of a pump assembly of an embodiment of the present invention.
Figure 4:
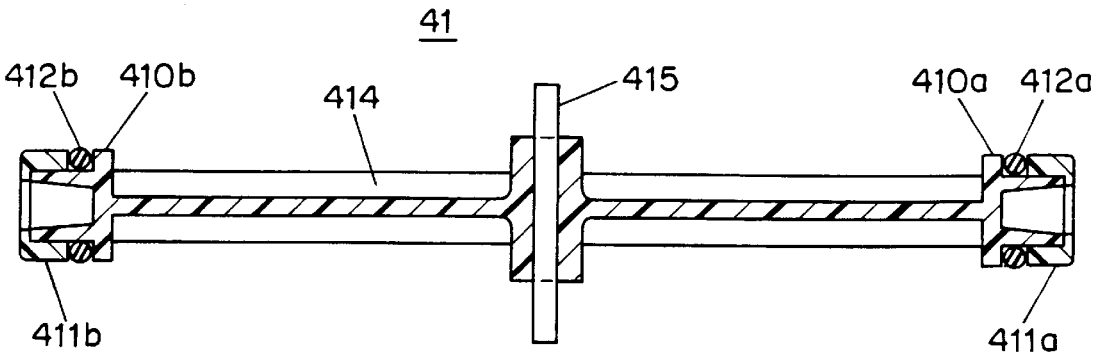
FIG. 4 is a cross-sectional top view of a piston of an embodiment of the present invention.

The pump assembly 40 is shown in detail in FIGS. 3A, 3B, and 4. The pump assembly 40 includes a piston 41 with two piston ends, 410*a* and 410*b*, and two cylinders, 42*a* and 42*b*. The piston 41 includes a shaft 414, which connects the two piston ends 410*a* and 410*b*. The shaft 414 contains a piston drive pin 415 disposed near the shaft's center. The two cylinders 42*a* and 42*b* have open ends 423*a* and 423*b*, respectively, for receiving the piston ends 410*a* and 410*b*. The piston ends, 410*a* and 410*b*, contain piston covers, 411*a* and 411*b*, and O-ring gaskets, 412*a* and 412*b*, respectively, which maintain a seal with the cylinder walls as the piston ends are moved back and forth along their respective cylinders.

Each cylinder (42*a*, 42*b*) has an intake port (421*a*, 421*b*) and a discharge port (422*a*, 422*b*) opposite its open end. Water is drawn into the intake ports and discharged out of the discharge ports through the cooperation of several conduits and one-way valves. Except for intake valve 49*a*, all the valves are coupled to their respective intake and discharge ports through annular flanges formed on the outside of the ports. Intake valve 49*a* is connected to intake port 421*a* through an auxiliary intake conduit 45 and an elbow coupling 471. Preferably, the auxiliary intake conduit 45 fits within valve 49*a* and elbow coupling 471. Elbow coupling 471 is connected to intake port 421*a* by an annular flange formed on the outside of intake port 421*a*.

Preferably, intake valves 49*a* and 49*b* are housed within the same assembly 49 and share a common water path on the valve sides opposite to the ones connected to intake ports 421*a* and 421*b*. The common water path of assembly 49 is coupled to main intake conduit 43, which leads to water tank 20. Preferably, the main intake conduit 43 contains a filter 431, which prevents particulate matter from getting into the conduit.

Discharge valve 48*b* is coupled to auxiliary discharge conduit 44. Discharge valve 48*a*, auxiliary discharge conduit 44, and main discharge conduit 46 are coupled together through a "T" connector 472. Main discharge conduit 46 is connected to nozzle 90.

Figure 11:
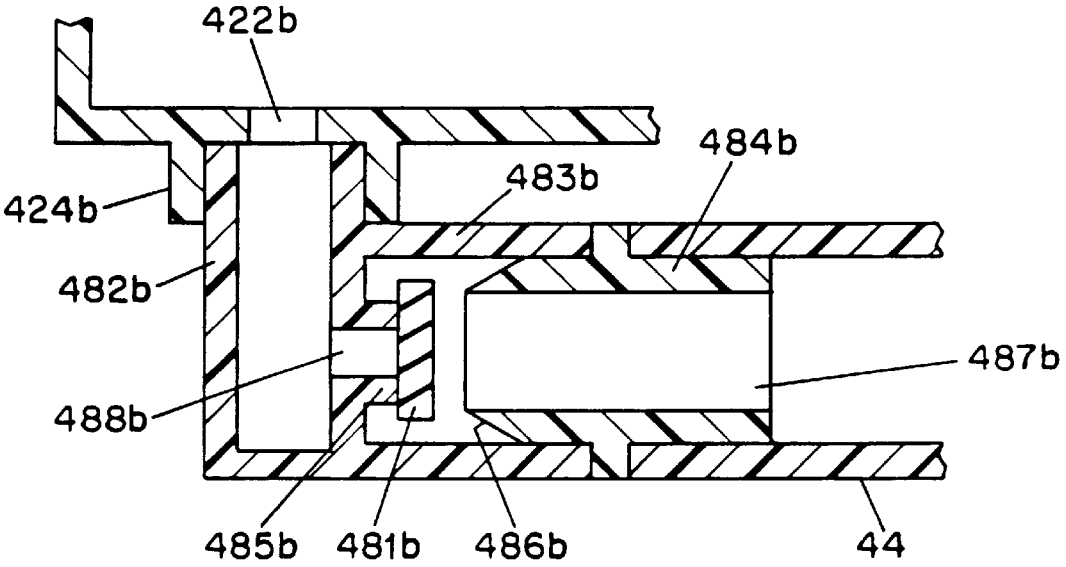
FIG. 11 is a cross-sectional side view of a one-way discharge valve of an embodiment of the present invention.

For the purposes of illustrating the structure and operation of the valves, valve 48*b* is shown in detail in FIG. 11. Valve 48*b* contains a first coupling member 482*b*, which fits inside an annular flange 424*b* formed on the outside of discharge port 422*b* of cylinder 42*b*. Coupling member 482*b* leads to a circular opening 488*b*, which is bounded by an annular rib 485*b*. Annular rib 485*b* serves as a valve seat over which an elastomeric valve disc 481*b* fits. Around valve disc 481*b*, a cylindrical wall 483*b* defines a channel for water to flow when the valve disc is not engaged with the annular rib. A second coupling member 484*b* has cylindrical walls with a tapered end 486*b* and an open end 487*b*. The tapered end 486*b* has notches within the tapered portion for the passage of water. The tapered end 486*b* fits within and couples to cylindrical wall 483*b* and the open end 487*b* fits within and couples to discharge conduit 44.

In operation, when water flows from discharge port 422*b* of cylinder 42*b* through coupling member 482*b* and opening 488*b*, the valve disc 481*b* is pushed against the tapered end 486*b* of coupling member 484*b*, and water flows through the notches in tapered end 486*b*. When the flow is reversed, valve disc 481*b* is pushed against annular rib 485*b*, sealing opening 488*b* and stopping the flow of water. The valve arrangement that has been described is merely illustrative and alternative arrangements may, of course, be used.

When the piston is operated, the pump assembly of the present invention delivers a continuous stream of water to the nozzle of the water gun. When piston 41 is driven back and forth, piston ends 410*a* and 410*b* deliver opposite strokes to cylinders 42*a* and 42*b*. When piston 41 is driven towards the front of the water gun (i.e., the nozzle end), piston end 410*a* delivers a discharge stroke to cylinder 42*a*, and water is discharged from cylinder 42*a* and out of nozzle 90 through the cooperation of discharge port 422*a*, discharge valve 48*a*, and main discharge conduit 46. At the same time as piston end 410*a* delivers its discharge stroke to cylinder 42*a*, piston end 410*b* delivers its intake stroke to cylinder 42*b*, and water is drawn into cylinder 42*b* from the water tank 20 through the cooperation of intake port 421*b*, intake valve 49*b*, and main intake conduit 43. When the piston stroke is reversed, and piston 41 is driven towards the rear (i.e., the water tank end), piston end 410*a* delivers its intake stroke to cylinder 42*a*, and water is drawn into the cylinder through the cooperation of intake port 421*a*, auxiliary intake conduit 45, intake valve 49*a*, and main intake conduit 43. At the same time as piston end 410*a* delivers its intake stroke to cylinder 42*a*, piston end 410*b* delivers its discharge stroke to cylinder 42*b*, and water is discharged from the cylinder and out of the nozzle through the cooperation of discharge port 422*b*, discharge valve 48*b*, auxiliary discharge conduit 44, and main discharge conduit 46. Thus, on both strokes of piston 41, water is delivered to the nozzle 90, and the nozzle shoots a continuous stream of water.

Figure 5:
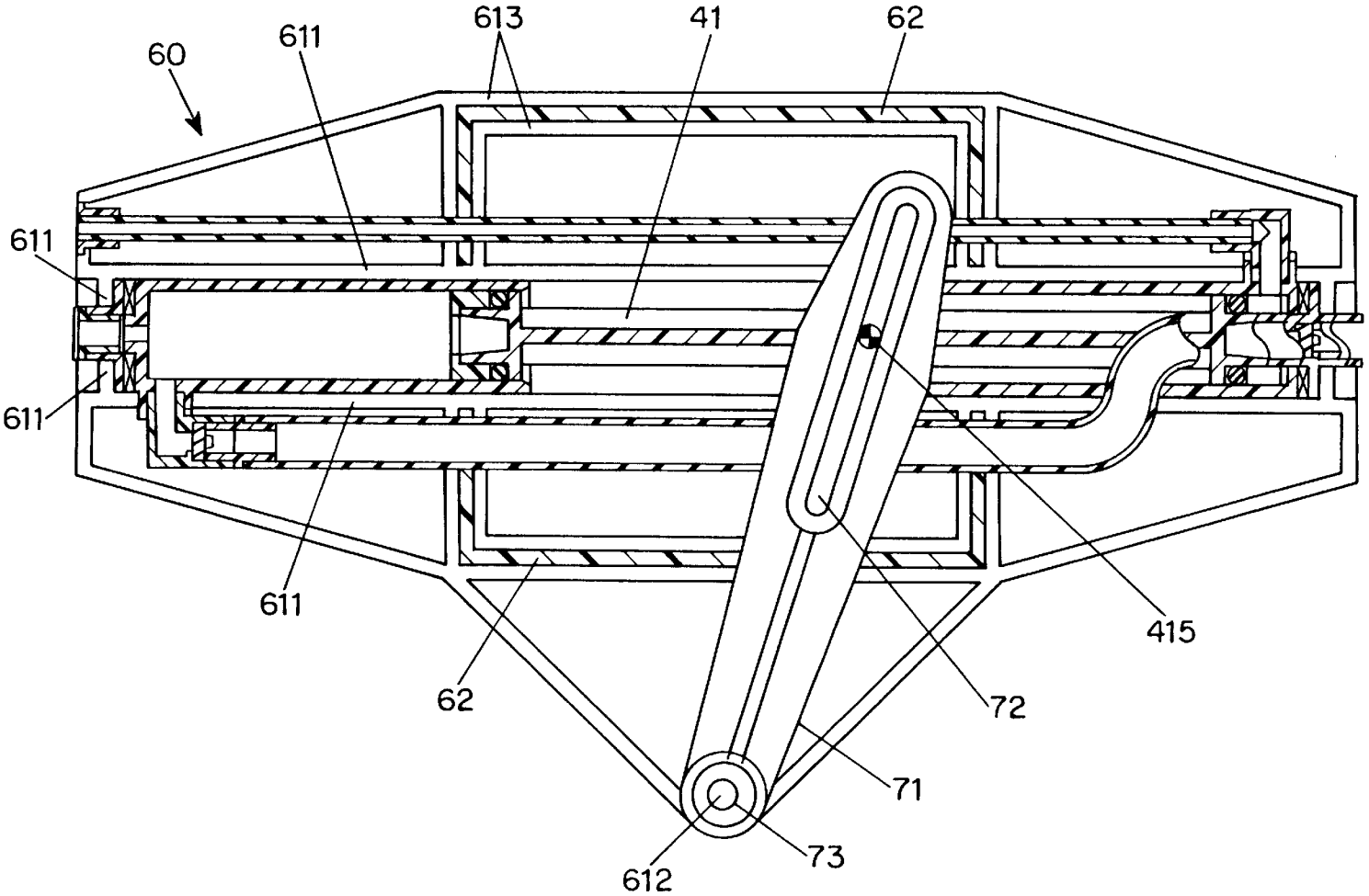
FIG. 5 is a cross-sectional side view of a pump assembly and cam arm of an embodiment of the present invention.
Figure 6:
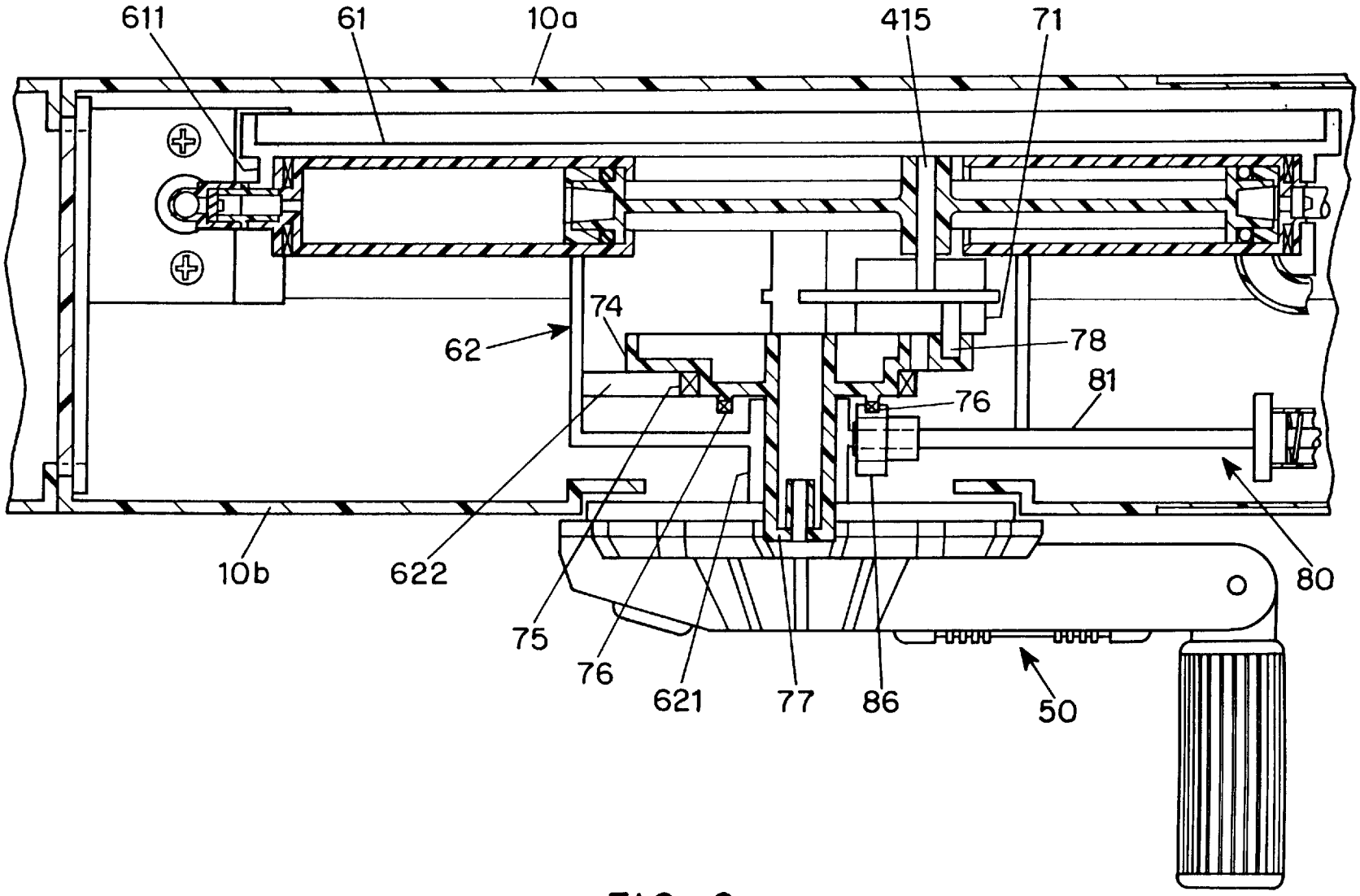
FIG. 6 is a cross-sectional top view of a pump assembly, piston drive assembly, and crank handle of an embodiment of the present invention.

FIGS. 5 and 6 illustrate a preferred embodiment of the piston drive assembly of the present invention. The piston drive assembly consists of a cam arm 71 and a coupling wheel 74. The cam arm 71 is an arm with an elongated slot 72 at one end and a pivoting means 73 for receiving a pivot pin 612 at the other end. The coupling wheel 74 includes a central shaft 77 on one side and a cam drive pin 78 on the other side. The central shaft is connected to the crank handle 50 by a screw or other similar engagement. The cam drive pin 78 is located along the outer edge of the coupling wheel 74.

The elongated slot 72 of the cam arm receives both the piston drive pin 415 and the cam drive pin 78. The two pins are inserted from opposite sides of the slot, and the depth of the slot is sufficient that the tips of the two pins do not overlap when viewed in side profile as in FIG. 6.

Although other configurations are possible, preferably the pivoting means 73 of the cam arm is 20 positioned halfway between each cylinder, 42*a* and 42*b*. In addition, it is preferred that the center of the coupling wheel 74 be positioned over the piston drive pin 415 when the two piston ends (410*a* and 410*b*) are both halfway through their strokes. In this configuration, it is also preferred that the diameter of the circle traced by the cam drive pin 78 be approximately equal to the length of each cylinder (42*a*, 42*b*) less the width of each piston end (410*a*, 410*b*), so that the cam arm 71 and coupling wheel 74 will drive each piston end (410*a*, 410*b*) through a full stroke in each cylinder (42*a*, 42*b*). Finally, it is preferred that the length of the elongated slot 72 be equal to or greater than the diameter of the circle traced by the cam drive pin 78.

In operation, when the crank handle 50 is turned, the central shaft 77, coupling wheel 74, and cam drive pin 78 rotate with the crank handle. The rotation of the cam drive pin 78 causes the cam arm 71 to swing back and forth in a pendulum-like motion about its pivoting means 73. As the cam arm 71 swings back and forth, the arm 71 exerts force and pushes the piston drive pin 415 back and forth, thereby operating the pump assembly.

The operation of the crank handle 50 may be either in the clockwise or counter-clockwise direction. In addition, the crank handle 50 may be operated with a back-and-forth motion, i.e., a motion alternating between a clockwise and a counter-clockwise direction.

Preferably, the cam arm 71 and the coupling wheel 74 are mounted to an internal support assembly 60, which is mounted to housing half 10*a*. The support assembly consists of a planar base 61 and a rectangular frame 62 mounted on the base. The planar base 61 contains flanges 611, in which the cylinders 42*a* and 42*b* are fitted. The planar base also includes pivot pin 612, about which the cam arm pivots. The rectangular frame 62 is mounted on the planar base through flanges 613, screws, or a combination of the two. The rectangular frame 62 includes openings in its sides for the cylinders and the cam arm. In addition, the frame 62 has a cylindrical shaft guide 621 on its top to support the central shaft 77 of the coupling wheel.

Preferably, the coupling wheel 74 includes two concentrically mounted gear wheels, i.e., a paddle drive gear wheel 75 and a barrel drive gear wheel 76. In connection with a paddle 622, one end of which is mounted on the rectangular frame 62 and the other end of which is mounted in contact with the teeth of paddle drive gear wheel 75, the paddle drive gear wheel 75 creates a noise effect when the coupling wheel rotates.

Figure 7:
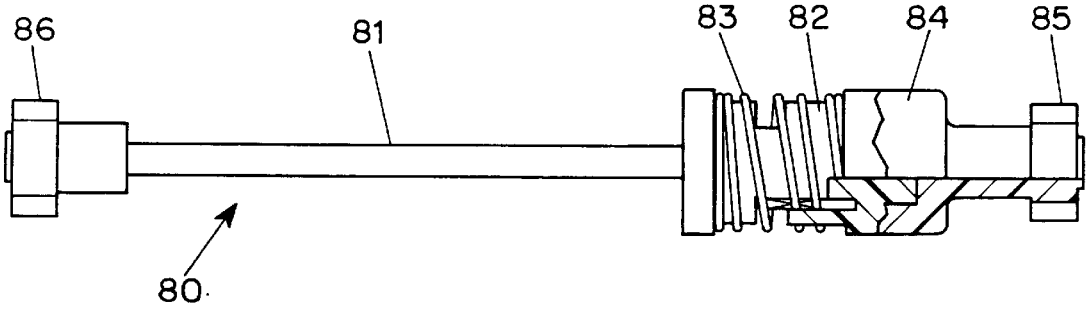
FIG. 7 is a side view of an outer barrel drive assembly of an embodiment of the present invention.

The barrel drive gear wheel 76 is coupled to the outer barrel by the outer barrel drive assembly 80, which is shown in FIG. 7. The outer barrel drive assembly 80 preferably includes a first coupling gear wheel 86 connected to a shaft 81. The shaft 81 is connected to a spring clutch 82, which is coupled to a gear clutch 84 through a spring 83. The gear clutch 84 is connected to a second coupling gear wheel 85. As shown in FIG. 2, barrel drive gear wheel 76 is coupled to the first coupling gear wheel 86, and the second coupling gear wheel 85 is coupled to outer barrel drive gear wheel 34. Accordingly, as the crank handle rotates the coupling wheel, the outer barrel rotates about the inner barrel.

Figure 8:
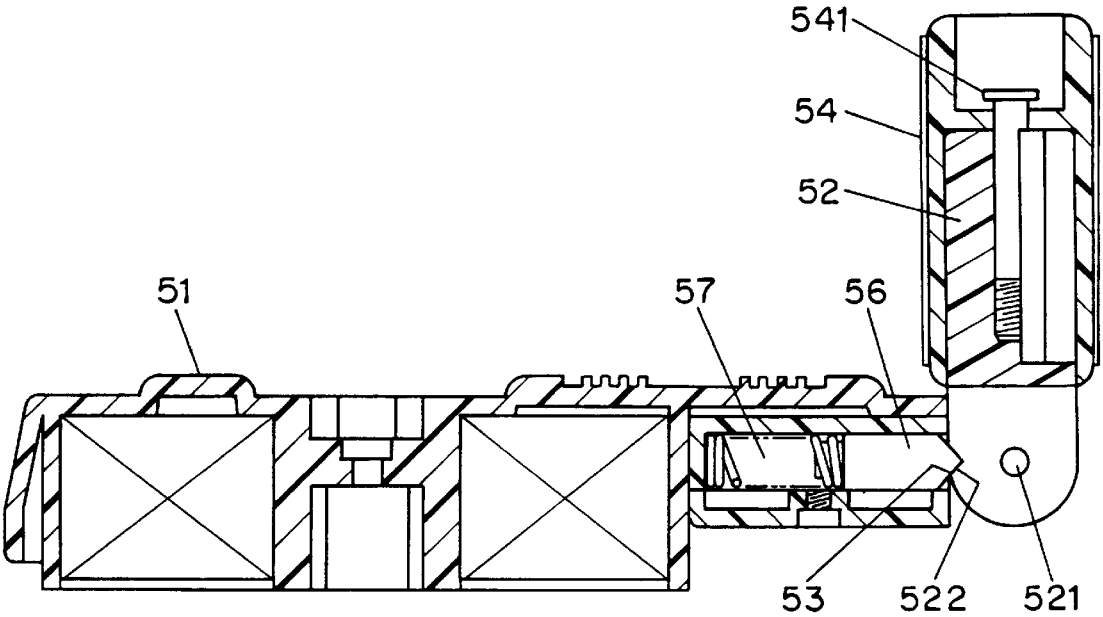
FIG. 8 is a cross-sectional top view of a crank handle of an embodiment of the present invention.

Referring to FIG. 8, a preferred embodiment of the crank handle 50 is shown. The preferred embodiment includes a crank base 51, which attaches to the central shaft 77, and a lever handle 52, which is pivotably attached to the crank base by pin 521 and which may be used to rotate the crank base. The crank base also includes a compartment 57 that contains a spring-loaded stopper 53. The stopper 53 has a tapered tip which fits within a notch 522 of the lever handle 52. When the handle 52 is rotated to a perpendicular position with base 51, the stopper 53 will engage the notch 522 and lock the handle 52 into place until the user provides sufficient force to disengage the stopper 53. For convenience in turning the handle 52, a roller 54 is rotatably mounted to the handle 52 by means of a pin 541.

Figure 9:
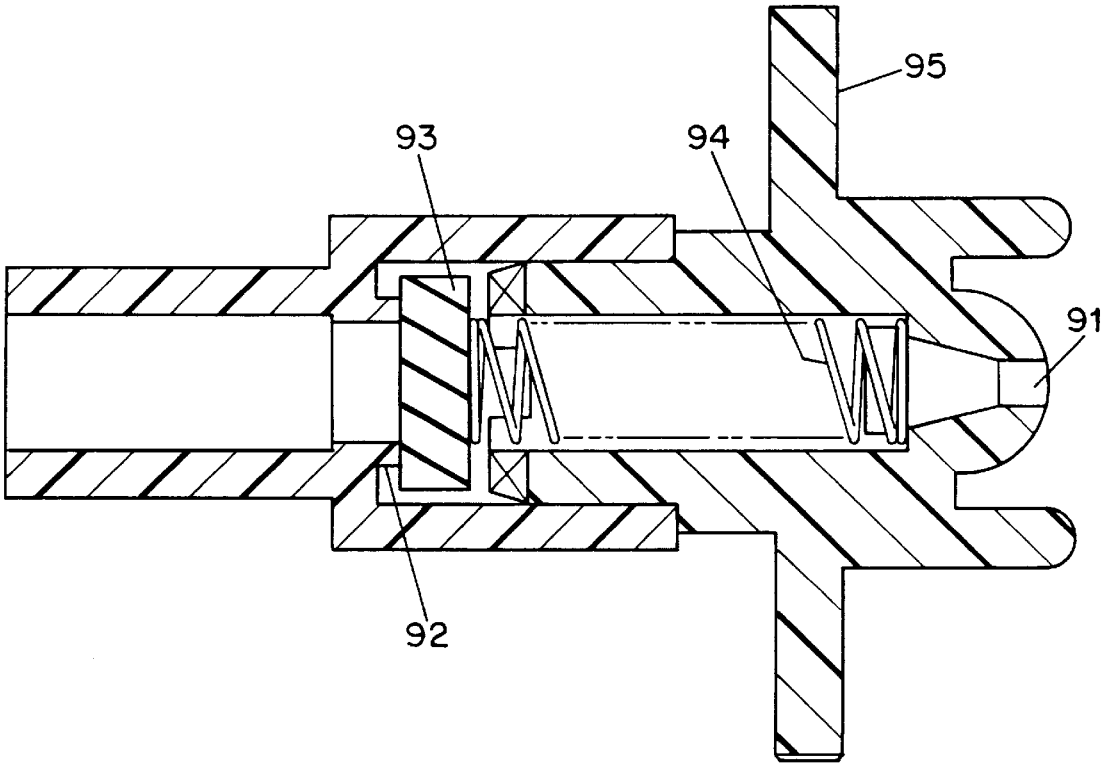
FIG. 9 is a cross-sectional top view of a nozzle of an embodiment of the present invention.

Referring to FIG. 9, a preferred embodiment of the nozzle 90 is shown. The structure and operation of the nozzle 90 is similar to the structure and operation of the one-way valves discussed previously. A difference between nozzle 90 and the one-way valves discussed previously is that nozzle 90 includes a spring 94, which exerts pressure on the elastomeric valve disc 93. Thus, a reverse flow of water is unnecessary to seal valve disc 93 against the annular valve seat 92. In addition, nozzle 90 contains a restricted opening 91 through which water is discharged. The restricted opening 91 causes the water to be discharged with greater pressure than would otherwise be the case. Nozzle 90 also contains an annular flange 95, which is received into groove 134 in the tip of the inner barrel and which holds the nozzle 90 in place.

Figure 10:
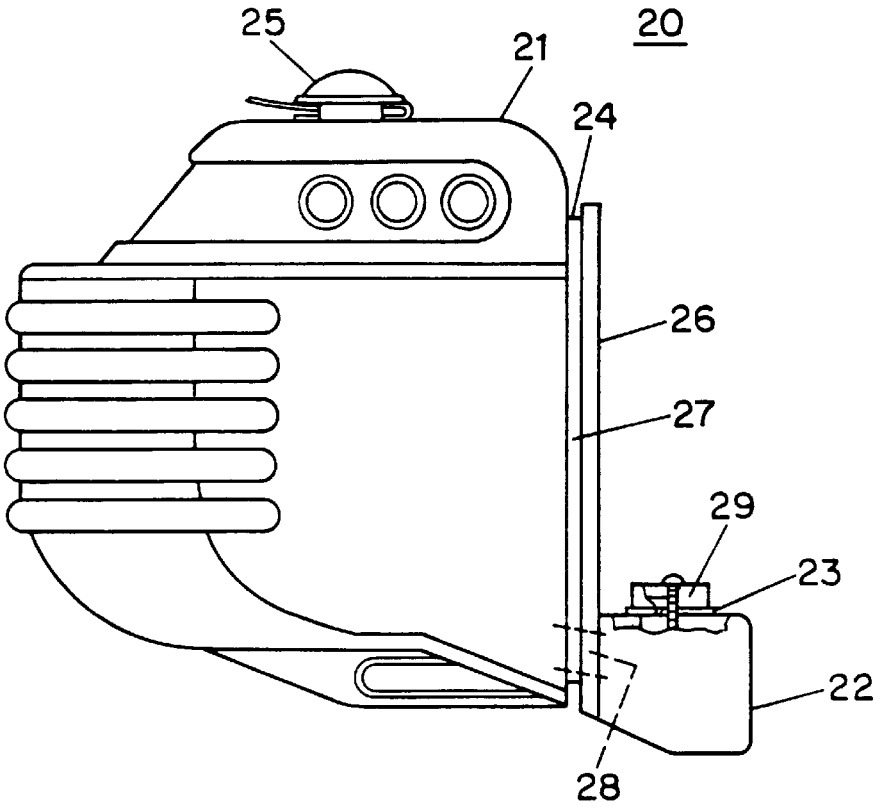
FIG. 10 is a side view of a water tank of an embodiment of the present invention.

Referring to FIG. 10, a preferred embodiment of the water tank 20 is shown. The water tank has a main, rear reservoir 21 and a smaller, forward reservoir 22. The small reservoir 22 is attached to an end piece 26, which has a contour slightly larger than the one defined by the inner edge of flange 14 of the housing 10. The main reservoir 21 is connected to the end piece 26 by means of a thin connecting piece 27 with a contour slightly smaller than the one defined by the inner edge of flange 14 of the housing 10. Accordingly, a groove 24 is formed between the main reservoir 21 and end piece 26 that receives the flange 14. The small reservoir 22 includes a sealing plate 29 and a gasket 23 that sealably couple the small reservoir 22 to main intake conduit 43. An opening 28 in the lower part of the end piece 26 and connecting piece 27 allows water to flow between the main reservoir 21 and the small reservoir 22. The main reservoir 21 also includes a cap 25, which is used to fill the water tank 20.

Although the present invention has been described with reference to certain preferred embodiments, other embodiments are possible and will be readily apparent to those skilled in the art. Therefore, the spirit and scope of the appended claims should not be limited to the preferred embodiments contained in this description.

I claim:

1. A toy water gun comprising:

(a) a housing;

(b) a water tank interconnected to the housing;

(c) a nozzle interconnected to the housing;

(d) a pump assembly mounted in the housing, the pump assembly comprising:

a first cylinder and a second cylinder, each cylinder having a first end with an opening for receiving a piston end and a second end with an intake port and a discharge port, a piston having a first piston end and a second piston end, a piston shaft between the first and second piston ends, and a drive pin located on the piston shaft, with the first and second piston ends inserted into the first open ends of the first and second cylinders, respectively, each piston end being slidable along the longitudinal axis of the cylinder into which it is inserted in sealing relation to the cylinder walls, means for filling the first and second cylinders with water from the water tank and means for discharging water from the first and second cylinders through the nozzle, wherein the means act in cooperation with the slidable movement of the first and second piston ends;

(e) a piston drive assembly comprising a cam arm and a coupling wheel, the cam arm having a first end with pivoting means for pivotably mounting the cam arm relative to the housing and a second end with an elongated slot, the coupling wheel having a central shaft on a first side and a cam drive pin on the side opposing the first side, the coupling wheel being rotatably mounted relative to the housing, wherein the coupling wheel is coupled to the cam arm by inserting the cam drive pin into a first side of the elongated slot, and the cam arm is coupled to the piston by inserting the piston drive pin into the side opposing the first side of the elongated slot; and (f) a crank handle attached to the central shaft of the coupling wheel, such that rotation of the crank handle causes cooperative movement between the crank handle, coupling wheel, cam drive pin and piston drive pin, thereby enabling the first and second piston ends to move cooperatively and provide a continuous stream of water to the nozzle.

2. The toy water gun of claim 1, in which the housing is comprised of two parts.

3. The toy water gun of claim 1, in which the means for filling and discharging water from the first and second cylinders comprise intake valves means that interconnect intake conduits to the intake ports of the first and second cylinders and discharge valve means that interconnect discharge conduits to the discharge ports of the first and second cylinders, the intake conduits being connected to the water tank, and the discharge conduits being connected to the nozzle.

4. The toy water gun of claim 3, in which a filter means for filtering particulate matter interconnects the intake conduits to the water tank.

5. The toy water gun of claim 1, further comprising a cylindrical inner barrel and a cylindrical outer barrel both disposed in the front of the housing.

6. The toy water gun of claim 5, in which the cylindrical inner barrel is mounted to the front of the housing and the cylindrical outer barrel is rotatably engaged to the inner barrel, and further comprising a first barrel drive gear concentrically mounted to the outer barrel, a second barrel drive gear concentrically mounted to the coupling wheel, and an outer barrel drive assembly for coupling the first barrel drive gear to the second barrel drive gear, whereby the outer barrel rotates around the inner barrel when the coupling wheel is rotated.

7. The toy water gun of claim 1, in which each piston end contains an O-ring gasket and a piston cover.

8. The toy water gun of claim 1, further comprising an internal support assembly on which the pump assembly, cam arm and coupling wheel are mounted.

9. The toy water gun of claim 8, further comprising a paddle gear and a paddle, the paddle gear concentrically mounted on the coupling wheel and the paddle mounted on the internal support assembly with one end of the paddle in contact with the teeth of the paddle gear, whereby a noise effect is created when the coupling wheel rotates.

10. The toy water gun of claim 1, in which the crank handle comprises a base attached to the central shaft of the coupling wheel and a lever handle pivotably attached to the base.

11. The toy water gun of claim 10, in which the base comprises a spring-loaded stopper which locks the lever handle into a position perpendicular to the base.

12. The toy water gun of claim 10, further comprising a roller rotatably mounted around the lever handle.

13. The toy water gun of claim 1, in which the nozzle comprises a spring-loaded elastomeric, one-way valve.

14. The toy water gun of claim 1, in which the center of the coupling wheel is coincident with the piston drive pin when both piston ends are halfway through their strokes; the diameter of the circle traced by the cam drive pin is approximately the length of each cylinder less the width of each piston end; the length of the elongated slot is equal to or greater than the diameter of the circle traced by the cam drive pin; and the pivoting means of the cam arm is positioned equidistant between the first and second cylinders.

* * * * *